United States Patent [19]

Koike et al.

[11] Patent Number: 4,635,606

[45] Date of Patent: Jan. 13, 1987

[54] FUEL SUPPLY CONTROL SYSTEM FOR INTERNAL COMBUSTION ENGINES, CAPABLE OF PREVENTING VAPOR LOCK

[75] Inventors: Akihiko Koike, Utsunomiya; Tadashi Umeda, Asaka, both of Japan

[73] Assignee: Honda Giken Kogyo K.K., Tokyo, Japan

[21] Appl. No.: 738,610

[22] Filed: May 28, 1985

[30] Foreign Application Priority Data

May 30, 1984 [JP] Japan ..... 59-79710[U]

[51] Int. Cl.[4] ..... F02M 55/02

[52] U.S. Cl. ..... 123/463; 123/459

[58] Field of Search ..... 123/357, 457, 458, 459, 123/461, 463

[56] References Cited

U.S. PATENT DOCUMENTS

| | | | |
|---|---|---|---|
| 4,377,145 | 3/1983 | Nagaishi | 123/463 X |
| 4,404,944 | 9/1983 | Yamazaki et al. | 123/463 X |
| 4,497,300 | 2/1985 | Maruyama et al. | 123/463 |
| 4,512,152 | 4/1985 | Asaba | 123/463 X |

FOREIGN PATENT DOCUMENTS

| | | | |
|---|---|---|---|
| 2743162 | 4/1979 | Fed. Rep. of Germany | 123/463 |
| 0094436 | 6/1980 | Japan . | |
| 0195062 | 11/1983 | Japan | 123/357 |

*Primary Examiner*—Willis R. Wolfe, Jr.
*Attorney, Agent, or Firm*—Arthur L. Lessler

[57] ABSTRACT

A fuel supply control system for an internal combustion engine, having fuel injection valves for supplying the engine with fuel having its pressure regulated to a predetermined value. A temperature sensor detects a temperature value representative of the temperature of fuel being supplied to the fuel injection valves. When the temperature value detected by the sensor is higher than a predetermined value at the start of the engine, an electronic control unit causes a solenoid-operated selector valve to operate to increase the pressure of fuel being supplied to the engine over a period of time dependent on the temperature value detected by the sensor from the time the engine is started.

4 Claims, 3 Drawing Figures

FUEL SUPPLY CONTROL SYSTEM FOR INTERNAL COMBUSTION ENGINES, CAPABLE OF PREVENTING VAPOR LOCK

BACKGROUND OF THE INVENTION

This invention relates to a fuel supply control system for internal combustion engines, and more particularly to a system of this kind which is intended to prevent occurrence of vapor lock in the fuel feed system of the engine upon starting and at the beginning of idling operation of the engine immediately following the start of the engine.

It is generally known that when the temperature of fuel in the fuel feed system of an internal combustion engine is high, vapor lock or formation of gas bubbles in the fuel can occur to cause undesirable variation in the amount of fuel supplied to the engine, degrading the driveability of the engine and even causing engine stall. Particularly in a high temperature condition such as in summertime, vapor lock can easily occur at the start of the engine and at the beginning of idling operation of the engine immediately following the start of the engine. If vapor lock occurs at the beginning of engine idling operation, the idling speed of the engine becomes unstable to badly affect the driveability of the engine to a larger extent than when such vapor lock takes place in other operating regions of the engine.

SUMMARY OF THE INVENTION

It is the object of the invention to provide a fuel supply control system for an internal combustion engine, which is capable of preventing formation of gas bubbles in fuel within the fuel feed system at and immediately after the start of the engine and promptly removing such gas bubbles already present in the same system, to thereby achieve stable idling operation of the engine as well as improve the driveability of same.

The present invention provides a fuel supply control system for an internal combustion engine, having pressure regulating means for regulating the pressure of fuel to a predetermined value, and at least one fuel injection valve for supplying the engine with fuel having pressure thereof regulated by the pressure regulating means. The system is characterized by comprising in combination: a temperature sensor for detecting a temperature value representative of the temperature of fuel being supplied to the fuel injection valve; fuel pressure modulating means for varying the pressure of fuel being supplied to the fuel injection valve; and control means for operating the fuel pressure modulating means in response to the temperature value detected by the temperature sensor in a manner such that the fuel pressure modulating means is operated to increase the pressure of fuel over a period of time dependent on the temperature value detected by the temperature sensor from the time the engine is started, when the temperature value detected by the temperature sensor is higher than a predetermined value at the start of the engine.

Preferably, when the temperature value detected by the temperature sensor after the lapse of the above-mentioned period of time is higher than a second predetermined value, the control means causes the fuel pressure modulating means to continually operate so as to increase the pressure of fuel until the temperature value detected by the temperature sensor becomes lower than the second predetermined value.

The above and other objects, features and advantages of the invention will be more apparent from the ensuing detailed description taken in conjunction with the accompanying drawings.

DETAILED DESCRIPTION

The invention will be described in detail with reference to the accompanying drawings.

Figure 1:
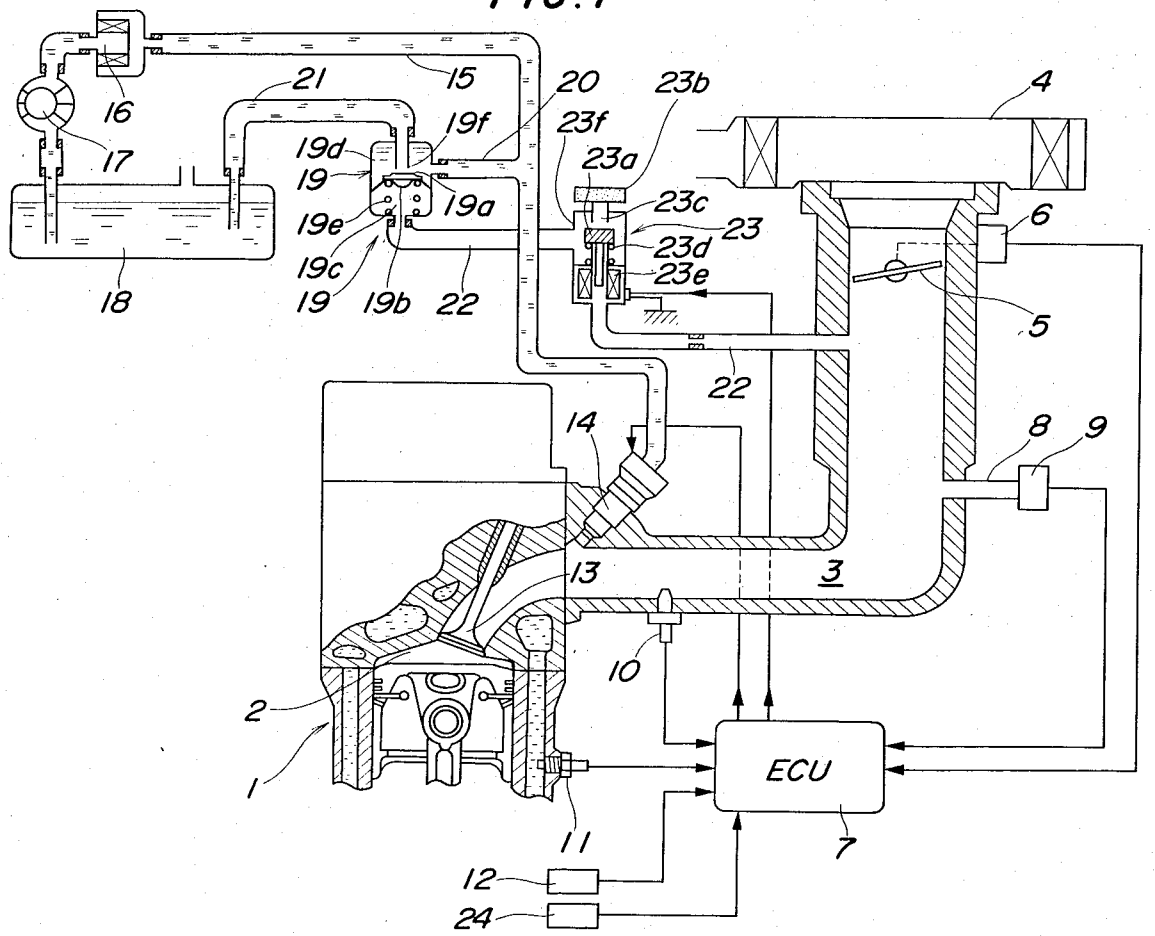
FIG. 1 is a view schematically illustrating the whole arrangement of a fuel supply control system according to the invention.

Referring first to FIG. 1, there is illustrated the whole arrangement of a fuel supply control system according to the invention. Reference numeral 1 denotes an internal combustion engine of a four-cylinder type for instance, to which is connected one end of an intake pipe 3, the other end of which communicates with the atmosphere via an air cleaner 4. A throttle valve 5 is arranged in the intake pipe 3, and a throttle valve opening sensor 6 is connected to the throttle valve 5 for detecting its opening and supplying an electrical signal indicative of the detected throttle valve opening to an electronic control unit (hereinafter called "the ECU") 7.

An absolute pressure sensor 9 communicates through a conduit 8 with the interior of the intake pipe 3 at a location immediately downstream of the throttle valve 5, of which an electrical output signal indicative of the detected absolute pressure is supplied to the ECU 7. Further, an intake air temperature sensor 10 projects into the interior of the intake pipe 3 at a location downstream of the conduit 8, for supplying the ECU 7 with an electrical signal indicative of the detected intake air temperature.

An engine cooling water temperature sensor 11 is mounted on the main body of the engine 1 in a manner embedded in the peripheral wall of an engine cylinder, for applying an electrical output signal indicative of the detected water temperature to the ECU 7. Reference numeral 12 denotes an engine rotational speed sensor arranged in face-to-face relation to an output shaft, e.g. a camshaft, of the engine for supplying the ECU 7 with an electrical signal indicative of predetermined crank angles detected thereby, while reference numeral 24 denotes an ignition switch, of which an electrical output signal indicative of its on and off states is inputted to the ECU 7.

Fuel injection valves 14 are arranged in the intake pipe 3 each at a location slightly upstream of an intake valve 13 of a corresponding one of the engine cylinders, and connected with a fuel tank 18 through a pipe 15 forming a first fuel passage, a filter 16, and a fuel pump 17. Each of the fuel injection valves 14, formed of an on-off type solenoid valve, has its solenoid, not shown, connected to the ECU 7 so that when energized by a driving signal from the ECU 7, it opens with its valve body, not shown, lifted through a constant stroke and for a period of time corresponding to the duration of the driving signal, as hereinafter referred to. Therefore, so long as the pressure of fuel being supplied to the fuel injection valves 14 remains constant, the engine is supplied with an amount of fuel corresponding to the time period for which the driving signals are applied to the valves 14 from the ECU 7, i.e. the duration of the driving signals (hereinafter called "the valve opening period"). On the other hand, as the fuel pressure rises, the engine is supplied with a correspondingly increased amount of fuel even if the valve opening period remains constant.

The fuel injection valves 14 have their valve opening periods set by the ECU 7 to values appropriate to operating conditions of the engine, on the basis of values of the output signals from various engine operation parameter sensors referred to above, such as the throttle valve opening sensor 6, the absolute pressure sensor 9, the intake air temperature sensor 10, the engine cooling water temperature sensor 11, the engine speed sensor 12, and an on-off state signal from the ignition switch 24. The ECU 7 supplies the fuel injection valves 14 with driving signals corresponding to the valve opening periods thus set to open same.

Pressure regulating means for regulating the pressure of fuel being supplied to the fuel injection valves to a predetermined value and fuel pressure modulating means for increasing the fuel pressure will now be described.

Reference numeral 19 denotes a pressure regulating valve, the casing of which has its interior divided by a diaphragm **19*b* into a vacuum chamber 19*c* and a fuel chamber 19*d*. The vacuum chamber 19*c* communicates through a vacuum passage 22 with the intake pipe 3 at a location downstream of the throttle valve 5, so as to be supplied with a vacuum or negative pressure in the intake pipe 3 at a zone downstream of the throttle valve 5, i.e. a negative pressure prevailing in the vicinity of the fuel injection valves 14, through the vacuum passage 22. A valve body 19*a* of the pressure regulating valve 19 is secured to the diaphragm 19*b* at its substantially central portion and urged via the diaphragm 19*b* by a spring 19*e* so that when the fuel pressure in the fuel chamber 19*d* is low, the valve body 19*a* is seated against a valve seat 9*f* formed at an open end of a pipe 21 communicating with the fuel tank 18 to close the open end. The fuel chamber 9*d* is communicated through a pipe 20 with the interior of the pipe 15 at a location between the filter 16 and the fuel injection valves 14, whereby the pressure of fuel being supplied to the fuel injection valves 14 is introduced into the fuel chamber 19*d*. The pressure regulating valve 19 forms the pressure regulating means in cooperation with the pipes 20, 21 and the vacuum passage 22**.

Arranged across the vacuum passage 22 is a solenoid-operated selector valve 23 as the fuel pressure modulating means, which comprises a casing **23*f*, a valve body 23*a* arranged within the casing 23*f*, a spring 23*d* urging the valve body 23*a* against an opening 23*c* in the casing 23*f* opening into the atmosphere through a filter 23*b*, and a solenoid 23*e* energizable to displace the valve body 21*a* against the urging force of the spring 23*d* so as to open the opening 23*c* to thereby allow introduction of the atmospheric pressure into the vacuum chamber 19*c* of the pressure regulating valve 19 while interrupting introduction of negative pressure in the intake pipe 3 into the vacuum chamber 19*c*. The solenoid 23*e* is electrically connected to the ECU 7**.

When the solenoid **23*e* of the selector valve 23 is deenergized, the opening 23*c* is blocked by the valve body 23*a* to allow negative pressure in the intake pipe 3 to be introduced into the vacuum chamber 19*c*, whereby the introduced negative pressure acts upon the diaphragm 19*b* to displace the valve body 19*a* away from the valve seat 19*f* against the urging force of the spring 19*e*, i.e. in a direction of establishing communication between the pipes 20, 21. On the other hand, the fuel pressure in the fuel chamber 19*d* also acts upon the diaphragm 19*b* to move the valve body 19*a* away from the valve seat 19*f*. Therefore, as the fuel discharge pressure of the fuel pump 17 increases, the valve seat 19*f* has its opening area increased to thereby increase the amount of fuel returned to the fuel tank 18 through the valve 19. If the amount of fuel returned to the fuel tank is thus increased, a corresponding drop occurs in the pressure of fuel supplied to the fuel injection valves 14, to thereby maintain the fuel pressure at a constant value so far as the negative pressure in the intake pipe 3 remains constant. On the other hand, when there occurs an increase in the negative pressure in the intake pipe 3, that is, the absolute pressure in the intake pipe 3 decreases, the diaphragm 19*b* is displaced to communicate the pipes 20, 21 with each other, thereby reducing the pressure of fuel supplied to the fuel injection valves 14. Although the fuel pressure drops on this occasion, the difference between the fuel pressure and the absolute pressure in the intake pipe 3 is maintained constant. Therefore, the fuel injection quantity is also maintained constant so long as the valve opening period set by the ECU 7** remains constant.

On the other hand, when the solenoid **23*e* of the solenoid-operated selector valve 23 is energized, the valve body 23*a* is displaced away from the opening 23*a* so that the vacuum chamber 19*c* of the pressure regulating valve 19 is increased in pressure with the supply of the atmospheric pressure higher than the absolute pressure in the intake pipe 3 downstream of the throttle valve 5. The increased pressure in the vacuum chamber 19*c* causes displacement of the diaphragm 19*b* in a direction of blocking the valve seat 19*f* with the valve body 19*a*, i.e. in a direction of disconnecting the pipes 20, 21 from each other, whereby a reduced amount of fuel is returned to the fuel tank to increase the fuel pressure. Therefore, so long as the valve opening period set by the ECU 7 remains constant, the quantity of fuel injected through the fuel injection valves 14** is increased by an amount corresponding to an increase in the fuel pressure.

Figure 2:
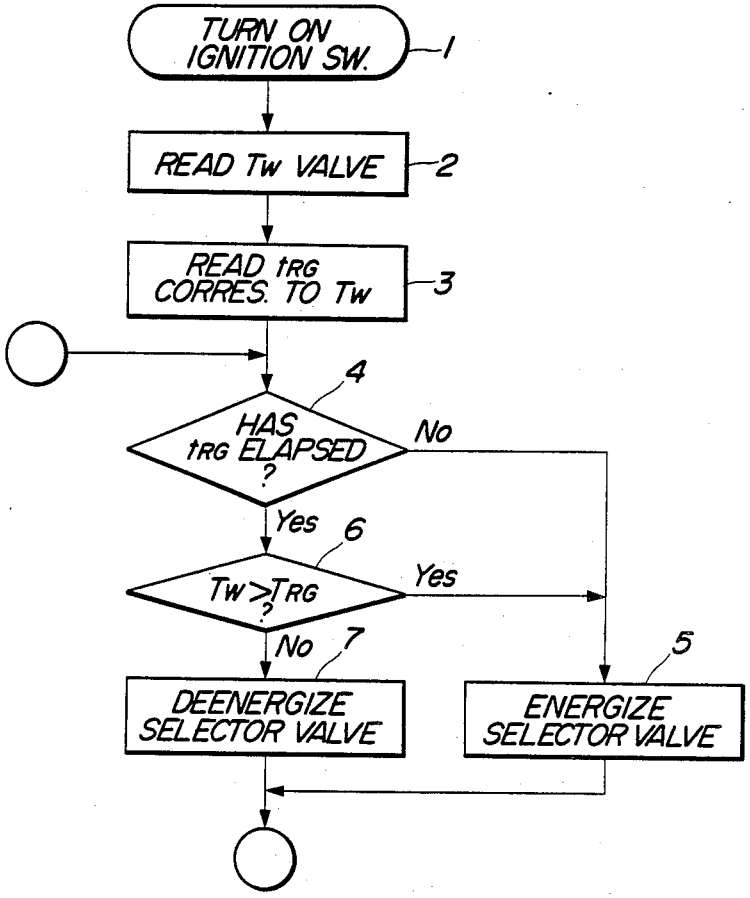
FIG. 2 is a flowchart showing a program for controlling a selector valve as fuel pressure modulating means, which is executed within an electronic control unit (ECU) in FIG. 1.
Figure 3:
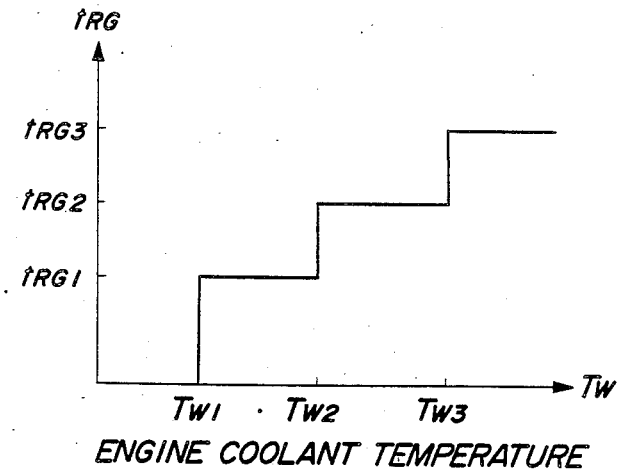
FIG. 3 is a graph showing an example of the relationship between a period of time tRG for which the selector valve is to be energized and the engine cooling water temperature TW.

FIG. 2 shows a program for controlling the solenoid-operated selector valve 23, which is executed within the ECU 7 in synchronism with a control signal generated at predetermined crank angles of the engine, or a control signal generated at constant intervals of time. Immediately after the ignition switch 24 has been turned on (step 1), the ECU 7 reads in a value of the temperature signal TW supplied from the engine cooling water temperature sensor 11 (step 2). Then, the program proceeds to the step 3 wherein a period of time tRG for which the solenoid-operated selector valve 23 is to be energized is set to a value dependent on the read value of the engine cooling water temperature TW. FIG. 3 shows the relationship between the energizing time period tRG and the engine cooling water temperature TW, by way of example. As shown in the figure, four different values are provided as the energizing time period tRG with respect to the engine cooling water temperature TW. That is, when the engine cooling water temperature TW is lower than a value TW1 (e.g.

90° C.), the energizing time period tRG is set to zero, while when the temperature TW is higher than or equal to the value TW1 and at the same time lower than a value TW2 (e.g. 95° C.), the energizing time period tRG is set to a value tRG1 (e.g. 10 seconds). When the temperature TW is higher than or equal to the value TW2 and at the same time lower than a value TW3 (e.g. 100° C.), the energizing time period tRG is set to a value tRG2 (e.g. 20 seconds), and when the temperature TW is higher than or equal to the value TW3, the energizing time period tRG is set to a value tRG3 (e.g. 30 seconds). When one of the energizing time period values tRGi is read from the table shown in FIG. 3, a counting value corresponding to the read value tRGi is set into a program counter, not shown, of the ECU 7 to be counted by the same counter. The counter initiates its counting upon turning-on of the starter switch, not shown, of the engine or when the engine speed exceeds a predetermined value (e.g. 400 rpm) immediately after the engine is started. The program then proceeds to the step 4 to determine whether or not the energizing time period tRG set at the step 3 has elapsed, that is, whether or not the counter has already counted the counting value corresponding to the set value tRGi. If the determination at the step 4 provides a negative answer (no), the ECU 7 generates a driving signal to energize the solenoid 23*e* of the solenoid-operated selector valve 23 (step 5).

The steps 1 through 3 are executed only once upon closing of the ignition switch 24, and in the following loops, the steps 4 et seq. are repeatedly executed from the entry point A. If the energizing time period value tRG is set to zero at the step 3, or when a period of time corresponding to the set value tRGi has elapsed, the answer to the question at the step 4 becomes affirmative (yes), and the step 6 is then executed to determine whether or not the engine cooling water temperature TW is higher than or equal to a predetermined value TRG (e.g. 90° C.). According to the invention, the temperature of fuel in the fuel feed system is estimated on the basis of the engine cooling water temperature value TW read in at the step 2, and in the following step 3, the energizing time period tRG is set to a value dependent on the estimated value of fuel temperature such that all the gas bubbles formed in the fuel can be removed from the fuel feed system. That is, the energizing time period tRG is set to such a value that high temperature fuel can be promptly removed from the fuel feed system to lower the fuel temperature to a level where there is no fear of formation of gas bubbles in the fuel feed system, by energizing the solenoid-operated selector valve 23 over a period of time corresponding to the set time period tRGi after the start of the engine to increase the amount of fuel injected through the fuel injection valves 14. Thus, according to the invention, by setting the energizing time period tRG to different suitable values in response to respective different values of the fuel temperature, gas bubbles formed in the fuel can be positively reduced to a level almost negligible during normal operation of the engine while almost perfectly preventing formation of such gas bubbles. However, sometimes energization of the solenoid-operated selector valve 23 over the time period tRG set as above is insufficient for lowering the fuel temperature to a level where almost no bubbles can be formed in the fuel. Therefore, even after the set time period tRG has elapsed, the step 5 is executed to continually energize the selector valve 23 if the fuel temperature is still high, that is, if it is determined at the step 6 that the engine cooling water temperature TW is higher than the predetermined value TRG.

If the answer to the question at the step 6 is no, that is, when the engine cooling water temperature TW is lower than or equal to the predetermined value TRG, the ECU 7 deenergizes the solenoid-operated selector valve 23 (step 7).

Although in the foregoing embodiment, the engine cooling water temperature TW detected by the engine cooling water temperature sensor 11 is employed as representative of the temperature of fuel in the vicinity of the fuel injection valves 14, the intake air temperature detected by the intake air temperature sensor 10 may alternatively be used for that purpose, or the fuel temperature per se may be detected in a direct manner by using a temperature sensor which may advantageously be arranged in the pipe 15 at a location immediately upstream of the fuel injection valves 14.

What is claimed is:

1. In a fuel supply control system for an internal combustion engine, having pressure regulating means for regulating the pressure of fuel to a predetermined value, and at least one fuel injection valve for supplying said engine with fuel having pressure thereof regulated by said pressure regulating means, said system comprising in combination:

a temperature sensor for detecting a temperature value representative of the temperature of fuel being supplied to said at least one fuel injection valve;

fuel pressure modulating means for varying the pressure of fuel being supplied to said at least one fuel injection valve; and control means for operating said fuel pressure modulating means in response to the temperature value detected by said temperature sensor;

the improvement wherein said control means is disposed to operate said fuel pressure modulating means to increase the pressure of fuel over a period of time dependent on the temperature value detected by said temperature sensor from the time said engine is started, when the temperature value detected by said temperature sensor is higher than a predetermined value at the start of said engine.

2. A fuel supply control system as claimed in claim 1, wherein when the temperature value detected by said temperature sensor after the lapse of said period of time is higher than a second predetermined value, said control means causes said fuel pressure modulating means to continually operate so as to increase the pressure of fuel until the temperature value detected by said temperature sensor becomes lower than said second predetermined value.

3. A fuel supply control system as claimed in claim 1, wherein said engine includes an intake passage in which said at least one fuel injection valve is arranged, said fuel supply control system including a fuel tank, a first fuel passage extending between said fuel tank and said at least one fuel injection valve, and a fuel pump arranged across said first fuel passage for pressure delivery of fuel from said fuel tank to said at least one fuel injection valve through said first fuel passage, said pressure regulating means comprising a second fuel passage branching off from said first fuel passage at a location between said fuel pump and said at least one fuel injection valve and connected to said fuel tank, a pressure regulating valve arranged across said second fuel passage for regulating the amount of fuel to be returned from said first fuel passage to said fuel tank through said second fuel passage, and a vacuum passage extending between said pressure regulating valve and said intake passage for introducing a pressure in said intake passage at a zone in the vicinity of said at least one fuel injection valve into said pressure regulating valve, said pressure regulating valve having a diaphragm displaceable in response to a difference between the pressure of fuel in said second fuel passage and the pressure in said intake passage to regulate the amount of fuel to be returned to said fuel tank.

4. A fuel supply control system as claimed in claim 3, wherein said fuel pressure modulating means comprises a solenoid-operated selector valve arranged in said vacuum passage, said selector valve being adapted to assume a first position in which it applies the pressure in said intake passage to said diaphragm of said pressure regulating valve, and a second position in which it applies the atmospheric pressure to said diaphragm, said control means comprising an electrical circuit adapted to supply said selector valve with a driving signal dependent on the temperature value detected by said temperature sensor at the start of said engine.

* * * * *